US006220030B1

(12) United States Patent
Clucas et al.

(10) Patent No.: US 6,220,030 B1
(45) Date of Patent: Apr. 24, 2001

(54) STIRLING ENGINE BURNER

(75) Inventors: Donald Murray Clucas; Geoffrey James Mentink, both of Christchurch (NZ)

(73) Assignee: Whisper Tech Limited, Christchurch (NZ)

( * ) Notice: Subject to any disclaimer, the term of this patent is extended or adjusted under 35 U.S.C. 154(b) by 0 days.

(21) Appl. No.: 09/601,641

(22) PCT Filed: Feb. 5, 1999

(86) PCT No.: PCT/NZ99/00013

§ 371 Date: Aug. 4, 2000

§ 102(e) Date: Aug. 4, 2000

(87) PCT Pub. No.: WO99/40309

PCT Pub. Date: Aug. 12, 1999

(30) Foreign Application Priority Data

Feb. 5, 1998 (NZ) ..... 329712

(51) Int. Cl.[7] ..... F01B 29/10
(52) U.S. Cl. ..... 60/517; 60/524
(58) Field of Search ..... 60/517, 522, 524

(56) References Cited

U.S. PATENT DOCUMENTS

| | | | | |
|---|---|---|---|---|
| 3,942,324 | * | 3/1976 | Johansson et al. | 60/517 |
| 3,965,976 | * | 6/1976 | Barton | 165/175 |
| 4,069,671 | * | 1/1978 | Berntell | 60/525 |
| 5,590,526 | * | 1/1997 | Cho | 60/517 |
| 5,794,444 | * | 8/1998 | Hofbauer et al. | 60/517 |

* cited by examiner

*Primary Examiner*—Hoang Nguyen
(74) *Attorney, Agent, or Firm*—Greer, Burns & Crain, Ltd.

(57) ABSTRACT

A burner for an external combustion engine using liquid or gaseous fuel, the burner being arranged for heat exchange between the inlet air to the burner and the exhaust air from the burner. The burner includes an external housing, a shroud within this housing, which shroud forms part of the centrally positioned combustion chamber. The burner includes air inlet apparatus and guide apparatus for guiding the inlet air to the combustion chamber, an igniter and fuel inlet apparatus and gas exhaust apparatus. The external housing, an element of the inlet apparatus, the guide apparatus, and heat exchange elements are formed as inverted shaped dishes or shells about the combustion chamber.

20 Claims, 2 Drawing Sheets

STIRLING ENGINE BURNER

TECHNICAL FIELD

This invention relates to a burner. The present invention is more particularly concerned with a burner for use in a heat exchange arrangement. It is particularly suitable for use with an external combustion engine where the engine is powered by a heat source and is not fuel dependent.

With an external combustion engine the heat developed from combustion of fuel in the burner is transferred through a heat exchanger to the working fluid of the engine. Such an external combustion engine can, for example, be one which operates on a Stirling Cycle.

BACKGROUND ART

A Stirling Cycle engine operates on a closed thermodynamic cycle in which one mass of gas is repeatedly expanded and compressed. Unlike an internal combustion engine, there are no valves, intake or exhaust ports, and no combustion in the cylinders. The engine therefore has very low noise output and can be dynamically balanced, thereby resulting in virtually no engine vibration. Little maintenance is required because the combustion products are kept away from the moving engine parts. A Stirling Cycle engine operates with externally heated cylinder heads. The burner of the present invention is thus particularly suited for providing the external heat source.

Desirably, a burner for a Stirling Cycle engine is able to burn different liquid and gaseous fuels. The burner should be quiet in operation otherwise the advantage of a quiet engine operation is lost. The burner desirably also has cool external surfaces and is sufficiently compact for mounting with the cylinder head of the engine. It goes without saying that the burner should also be efficient.

Examples of such burners can be seen in U.S. Pat. Nos. 4,352,269 (Dineen), 5,005,349 (Momose) and 5,590,526 (Cho). In Cho and Momose, either the inlet air or the exhaust air follows a passage that allows for heat exchange from the combustion chamber. Momose also permits some heat exchange between the exhaust gases and the inlet air, but only on one pass of the inlet air past the exhaust gas passageway. Dineen discloses a burner with an annular heat exchange means and an annular burner about the Stirling engine. The exhaust is centrally located at the top of the burner.

However these three burners have a limited amount of thermal connection between the inlet air and exhaust gases, reducing the efficiency of the heat exchange aspects of the burner. Also, with the burner disclosed in Dineen portions of the exterior of the burner will be hot as they are immediately adjacent the exhaust gas passageways of the burner.

A further difficulty of the disclosed burners is the complexity of manufacture or construction of the burner disclosed.

It is an object of the present invention to provide a burner for an external combustion engine which effectively addresses the question of efficient heat exchange with in the burner. It is a further object of the present invention to provide a burner which addresses the question of simplicity of manufacture.

A yet further object of the present invention is to provide a burner which meets or goes some way to achieving all or some of the aforementioned requirements or at least to provide the public with a useful choice.

Further aspects and advantages of the present invention will become apparent from the ensuing description which is given by way of example only.

DISCLOSURE OF INVENTION

According to one aspect of the present invention there is provided a burner or an external combustion engine, said burner comprising:

an external housing;

a shroud within the external housing, said shroud in use defining at least in part a centrally located combustion chamber;

inlet air means from which inlet air is directed over an internal wall surface of the housing for cooling thereof;

guide means for directing inlet air to the combustion chamber, said guide means directing the inlet air such that, in the use of the burner, the inlet air effects a cooling of the shroud prior to the inlet air entering the combustion chamber;

fuel inlet means directing the fuel to the combustion chamber;

an igniter for igniting the fuel; and gas exhaust means; characterized in that said external housing, the shroud and the guide means are formed as a series of nested layers about the combustion chamber, said layers being arranged to maximized the heat exchange between any two adjacent layers.

In the preferred form of the invention there is provided heat exchange means whereby inlet air, after having applied a cooling effect to the housing, is heated before being directed to the shroud. Preferably, the heat exchange means has inlet means for receiving exhaust gases from the combustion chamber, and outlet means connected to the gas exhaust means.

In the preferred form of the invention the burner is adapted for mounting to the external combustion engine, which most preferably is an engine operating on a Stirling Cycle.

Preferably, the means for directing air flow to the combustion space includes heat exchange means with the exhaust gases, for heating said air flow.

Preferably, the combustion space is defined at least in part by the shroud over which air heated by said heat exchange means passes before entering said combustion space.

BRIEF DESCRIPTION OF DRAWINGS

Further aspects of the present invention will become apparent from the following description, which is given by way of example only, and with reference to the accompanying drawings in which.

BEST MODES FOR CARRYING OUT THE INVENTION

Figure 1:
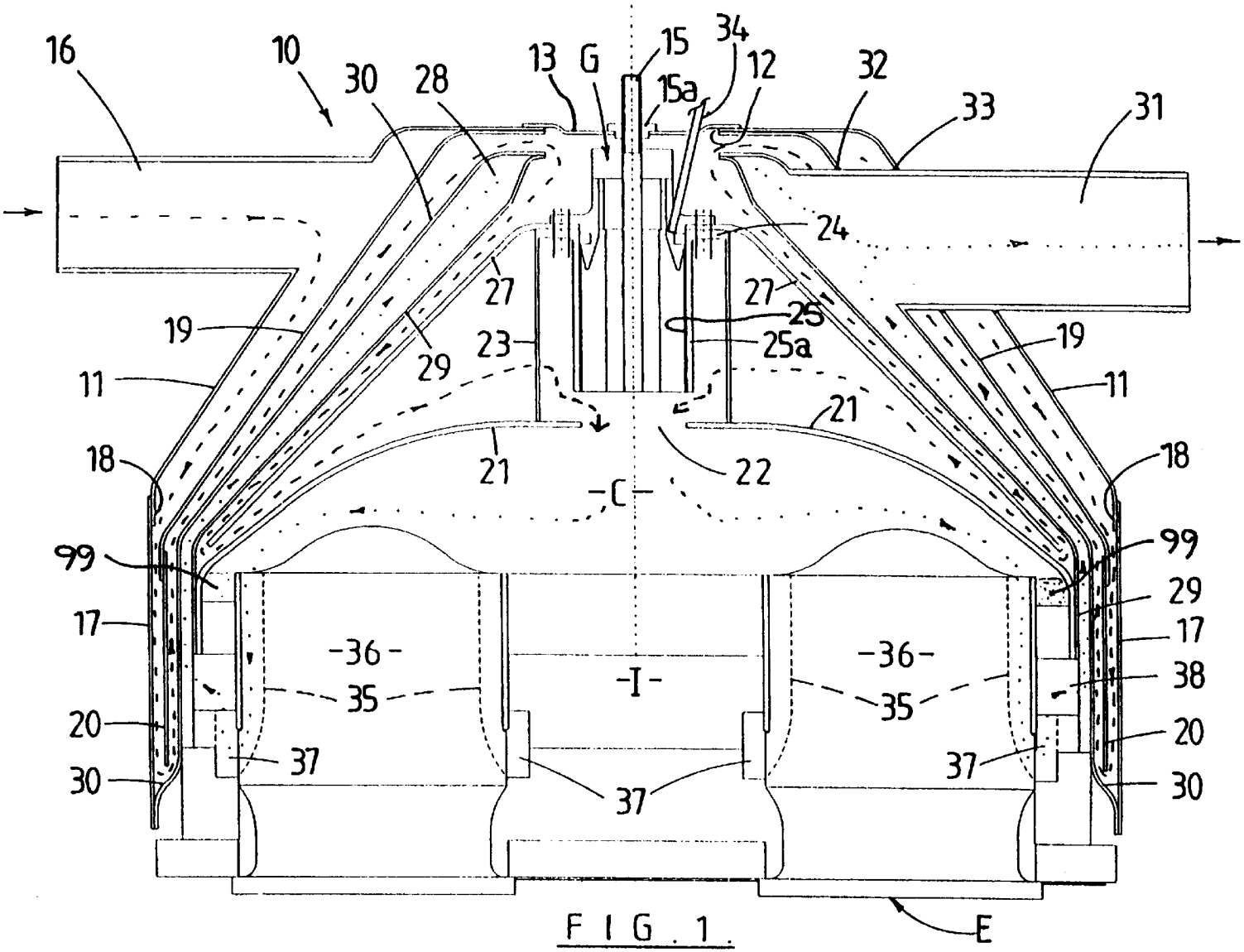
FIG. 1 is a section view of the preferred embodiment of the burner of the present invention.

Referring to FIG. 1, a burner 10 for a Stirling cycle engine E is there shown. The burner 10 is primarily formed from sheet steel. As will become apparent from the following description, many of the components can be fabricated by the known technique of metal spinning.

Figure 2:
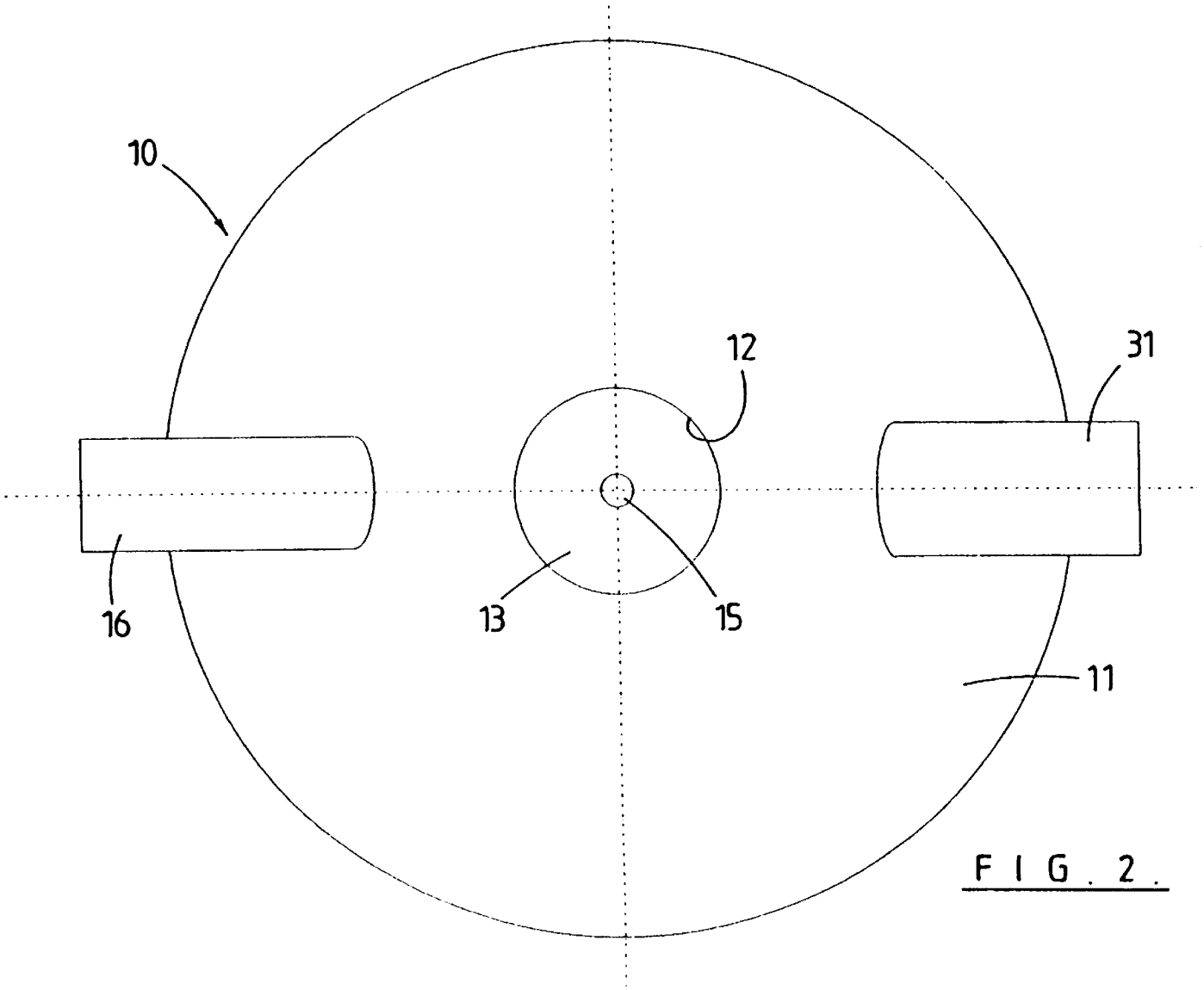
FIG. 2 is a plan view of the preferred embodiment of the burner of the present invention.

Referring to both the FIGS. 1 and 2, the burner 10 includes an outermost or external housing 11. The external housing 11 can be generally described as being a shell which is substantially of an inverted dish shape. In the drawings and in the description following, the 'base' of the inverted dish is uppermost, so that the sides of the external housing 11 slope upwardly and inwardly.

However, it will be appreciated by those skilled in the art that the burner 10 can be at any orientation; the description of the 'base' of the shell of the housing 11 as being uppermost being used here only as an example and for ease of description of the elements of the burner 10.

A central opening 12 is formed in the external housing 11 which has a cover plate 13 with a central orifice through which a connector end of an igniter 15 is located. A grommet or seal element 15*a* can be provided to form a seal between the opening 12 and igniter 15. The igniter 15 may be of any conventional type, for example the igniter 15 may be a glow plug or a spark igniter, as is desired.

Opening into the housing 11 is a duct 16 which is connectable to a blower (not shown) for the introduction of air. According to a preferred form of the invention the air is preheated slightly by, for example, the crank case (not shown) of the engine E to which the burner 10 is fitted, in the preferred embodiment.

A skirt or extension 17 projects downwardly from the terminal lower end 18 of the housing 11. The skirt 17 may be of any shape, but is preferably cylindrical in cross-section.

Located inwardly from the inside wall surface of the housing 11 and extending down from the uppermost part of the housing 11, in which opening 12 is formed, is a partition wall 19. As with the housing 11, this wall 19 is formed by a shell and is substantially an inverted dish in shape. As with the housing 11, the partition wall 19 is provided with an extension formed by a skirt 20 which terminates above the terminal edge of skirt 17. The skirt 20 may also be of any shape, but is preferably cylindrical in cross-section.

The external housing 11 and associated skirt 17 are shown in FIG. 1 as being two separate parts. However it will be appreciated by those skilled in the art that these two parts may be formed integrally. Likewise, the partition wall 19 and skirt 20 are shown in FIG. 1 as two parts, but may be formed integrally, as is desired.

The burner 10 has an inner shroud or shell 21 which as shown mounts on the hot end of the engine E. It will be appreciated by those skilled in the art that the hot end of engine E is only represented diagrammatically to illustrate the mounting and relationship of the burner 10 on the engine E. In addition to providing the means of mounting the burner 10 to the engine E, the inner shell 21 defines with the top end of the engine E a combustion zone within the combustion chamber C.

Thus, the combustion chamber C is formed and bounded by the inner shell 21, with a central opening 22 through which hot air and fuel flow, a seal 99, and by the top of the engine E with heat exchangers 36, each heat exchanger 36 having attendant cooling fins 35.

The centrally disposed opening 22 is formed in the shell 21. Extending upwardly, and substantially concentric with opening 22, is a tubular member 23. The upper end of the tubular member 23 provides, or is associated with, a mounting flange 24. The tubular member 23 incorporates perforations (not shown) along the length thereof and about the circumference. Thus the tubular member 23 permits the air to flow across the upper surface of the shell 21, to the central opening 22. The perforations may be circular holes, slots, louvers, or a combination of these, as is desired. Alternatively, if desired, the tubular member 23 may be of a mesh material.

A second tubular member 25*a* depends downwardly from the mounting flange 24 and is substantially concentric with tubular member 23. This second tubular member 25*a* terminates above the portion of the inner shell 21.

The mounting flange 24 provides a means of mounting, via mechanical fasteners (not shown) of known type, an igniter assembly G with a fuel line injector 34. The assembly G and injector 34 fit into the central opening 12 of the external housing 11. The assembly G also includes a flange by which the assembly G is secured to the mounting flange 24.

Sandwiched between the flange of the igniter assembly G and the mounting flange 24 is the upper end of a second inverted shell 27. The second inverted shell 27 is also dish shaped. As can be seen in FIG. 1 of the drawings, this second shell 27 extends downwardly towards the first inner shell 21 but terminates short thereof. Preferably, the gauge thickness of inner shells (21, 27) is greater than that of the other components of the burner 10.

Located between partition wall 19 and second inner shell 27 is an exhaust chamber 28 formed by yet further substantially dish shaped exhaust elements (29, 30). The upper ends of the exhaust elements (29, 30) are joined together but not joined to the partition wall 19 nor the outer housing 11. The lowermost end of the exhaust element 29 is fastened to the lower end of the first inner shell 21. The corresponding lowermost end of the other second exhaust element 30 extends downwardly and is substantially parallel to the skirt 20. This lowermost end of the second exhaust element 30 extends below the end of the skirt 20, and bends towards the skirt 17 and is fastened thereto at the end of the skirt 17 and the lowermost end of the second exhaust element 30.

Coupled to the second exhaust element 30 is an exhaust duct 31 which extends through two openings (32, 33) formed in the partition wall 19 and the outer housing 11 respectively. The exhaust duct 31 can include fins (not shown), to increase the heat transfer area of the duct 31.

The elements generally called 'shells' (11, 19, 30, 29, 27, 21), which make up the various main components of the burner 10, are not rigidly inter-connected. This lack of rigid inter-connection reduces thermal stress within the material of the shells (11, 19, 30, 29, 27, 21), and in the burner 10 generally, as it allows for the thermal expansion of the shell metal. Minimal welding of the shells (11, 19, 30, 29, 27, 21) is thus required and that which is needed is very easy.

The above described burner 10 works as follows: fuel from the injector 34 progresses under capillary action along a mesh 25 mounted on the inner wall of second tubular member 25*a*. The tubular member 25*a* is heated by the incoming heated air flow over the outer surface of the tubular member 25*a*. This enables vaporized fuel to pass to the combustion zone of the combustion chamber C.

As indicated by dashed flow lines, cold air from the blower enters the external housing 11 via the duct 16 and passes over the inner surface of the external housing 11. This achieves a cooling effect so that the outer surface of the housing 11 remains cool.

The air then passes along a flow guide formed by the spaced apart inner partition wall 19 and the second exhaust element 30 of the exhaust chamber 28. The air flows around the end of the exhaust chamber 28 to flow along a further flow guide formed by the second inner shell 27 and the first exhaust element 29 of the exhaust chamber 28. This flow of air over the exhaust chamber 28 thus provides for heat recovery with the result that the cool inlet air is further heated. Also, the exhaust gases are further cooled.

The heated inlet air then passes over the upper surface of the inner shell 21 to reduce the temperature of the inner shell 21. The air is heated further and the shell 21 is cooled by this air flow. This ensures that the inner shell 21 does not become over-heated.

The heated air then flows into a space, which functions as a swirl generator space, through the perforations in the tubular member 23. A rotating flow of air is created in the swirl generator space (between the tubular member 23, the second tubular member 25*a* and the central opening 22). The turbulent air then flows down through the central opening 22 into the combustion chamber C. The turbulence initiated in the swirl generator space increases in rotational velocity as the air passes through the central opening 22. This creates a strong vortex mixing zone in the top part of the combustion chamber C and causes good combustion to occur in the combustion zone of the combustion chamber C.

The flow of hot, combusted gases from the combustion zone of the combustion chamber C, as shown by the dotted line in FIG. 1, passes over the fins 35 of each of the hot end heat exchangers 36 of the engine E. The combusted gases then pass into an annular duct 37 and out through an exhaust port 38 into the exhaust chamber 28. The exhaust gases then exit through the exhaust duct 31. The exhaust gases can be recovered for further use. Such further use could, for example include use in a water heater or space heating arrangement. This is particularly useful when the engine E forms part of a domestic co-generation system. Other uses for the exhaust gases will be apparent to those skilled in the art.

Initial fuel vaporization and ignition is achieved from the igniter G in known manner. Once combustion has been initiated in the combustion chamber C, a continuous flame in the combustion zone of the combustion chamber C forms the heat source. Thus, the combustion process is optimised and the emission of pollutants minimised.

The burner 10 can burn a fuel selected from the group: diesel, liquid petroleum gas, natural gas, and other liquid and gaseous fuels. The burner 10 can do so with minimal or no change to the burner 10 itself. The burner 10, according to the present invention, provides a number of advantages which results in the burner 10 being particularly suited for use with a Stirling Cycle engine.

What is claimed is:

1. A burner for an external combustion engine, said burner comprising:

an external housing;

a shroud within the external housing, said shroud in use defining at least in part a centrally located combustion chamber;

inlet air means from which inlet air is directed over an internal wall surface of the housing for cooling thereof;

guide means for directing inlet air to the combustion chamber, said guide means directing the inlet air such that, in the use of the burner, the inlet air effects a cooling of the shroud prior to the inlet air entering the combustion chamber;

heat exchange means whereby inlet air, after having applied a cooling effect to the housing, is heated before being directed to said shroud;

fuel inlet means directing the fuel to the combustion chamber;

an igniter for igniting the fuel; and gas exhaust means; wherein said external housing, the shroud, heat exchange means and the guide means define a series of nested passageways about the combustion chamber, said passageways being arranged to maximize the heat exchange between the exhaust gases and inlet air.

2. A burner for an external combustion engine as claimed in claim 1 wherein said heat exchange means includes inlet means for receiving exhaust gases from the combustion chamber and outlet means as a part of the gas exhaust means.

3. A burner for an external combustion engine as claimed in claim 1 wherein said external housing further includes a skirt extending downwardly from a wide end of said housing, said skirt being approximately straight sided.

4. A burner for an external combustion engine as claimed in claim 1 wherein a partition wall forming part of the guide means has a profile which is complementary to the profile of the external housing, said partition wall directing the inlet air over the internal wall surface of said external housing.

5. A burner for an external combustion engine as claimed in claim 4 wherein said partition wall further comprises an extension skirt which extends downwardly from the wide end of said partition wall, said skirt being approximately straight sided, and at the lower end thereof being spatially apart from the lower end of the skirt of the external housing.

6. A burner for an external combustion engine as claimed in claim 1 wherein said engine includes one or more heat exchangers, each about a cylinder of the engine, each heat exchanger having attendant cooling fins which are incorporated into a passageway about the respective cylinders; wherein the combustion chamber is formed by the shroud with a central opening therethrough, and the or each heat exchanger, the top of the engine case and a seal between said shroud and the engine case.

7. A burner for an external combustion engine as claimed in claim 1 wherein said heat exchange means comprises an exhaust gas passageway which is formed from two elements which are complementary in shape to the shape of the external housing, said exhaust passageway having elongated first and second sides generally parallel to exhaust gas flow in a first direction, such that inlet air flows generally in the said first direction, along a path adjacent to the said first side of the passageway, and subsequently flows generally in a direction contrary to the said first direction along a path adjacent to the said second side of the passageway.

8. A burner for an external combustion engine as claimed in claim 1 wherein said two elements are secured to each other at the respective top ends; the lower end of the outer element being secured at the lower end to a lower end of the external housing.

9. A burner for an external combustion engine as claimed in claim 1 wherein said external housing is formed in the shape of an inverted dish, being cylindrical, with a truncated conical top section and wherein the air inlet and exhaust outlet are toward the top of the said housing and the said passageways within the said housing are annular in section.

10. A burner for an external combustion engine as claimed in claim 1 wherein the guide means includes a tubular member which extends between the shroud and the inner end of the air inlet means, said member being positioned about the said igniter and above the combustion chamber, said member further including perforations on the surface thereof, the perforations allowing air to pass from across the shroud, past the igniter and into the combustion chamber.

11. A burner for an external combustion engine as claimed in claim 1 wherein said external housing, shroud, air inlet means, guide means and gas exhaust means are all constructed of metal or metal alloy.

12. A burner for an external combustion engine as claimed in claim 1 wherein the shroud and an element of the guide means are of a greater thickness than the external housing and the heat exchange elements.

13. A burner for an external combustion engine as claimed in claim 1 wherein said fuel is selected from the group: diesel, liquid petroleum gas, natural gas, coal gas, other gaseous fuel, and other liquid fuels.

14. A burner for an external combustion engine as claimed in claim 1 wherein said burner is adapted for mounting to, and is mounted on, the external combustion engine.

15. A burner for an external combustion engine as claimed in claim 1 wherein said engine runs on a Stirling Cycle.

16. A burner for an external combustion engine as claimed in claim 1 wherein said external housing includes a central opening through which is secured said igniter and the fuel inlet means.

17. A burner for an external combustion engine as claimed in claim 1 wherein said igniter is selected from either a spark igniter or a glow plug.

18. A burner for an external combustion engine as claimed in claim 1 wherein the inlet air is pre-heated before the air reaches the air inlet means.

19. An external combustion engine with a burner secured thereto, characterized in that said burner is as claimed in claim 1.

20. An external combustion engine with a burner secured thereto, characterized in that said burner is as claimed in claim 5.

* * * * *

UNITED STATES PATENT AND TRADEMARK OFFICE

CERTIFICATE OF CORRECTION

PATENT NO. : 6,220,030 B1
DATED : April 24, 2001
INVENTOR(S) : Clucas et al.

It is certified that error appears in the above-identified patent and that said Letters Patent is hereby corrected as shown below:

Column 2,
Line 3, delete "or" and add -- for --
Line 23, delete "maximized" and add -- maximize --

Column 5,
Line 38, after "...Stirling Cycle Engine." and before "What is claimed is:" add
-- These advantages include:-
1. An ability to operate with a number of liquid and gaseous fuels with minimal or no change to the burner 10.
2. A cool exterior surface due to cool inlet air being directed over the interior surface of the external housing 11. This prevents heating of any enclosure in which the engine E is located. Also, it reduces the risk of users being burned. It furthermore improves efficiency of the burner 10.
3. The construction of the burner 10 reduces and in many situations obviates the need to use high temperature resistant ceramic insulation on the outer burner shell 11.
4. Provides a compact flame zone and effective flow of the combustion products over the hot end heat exchanger(s) 36 of the cylinder head(s).
5.The flow of incoming air over the surfaces (29, 30) of the exhaust chamber 28 provides improved heat recovery to improve burner efficiency, and permits vaporization of any liquid fuel used.
6. The burner 10 provides lower gas flow resistance.
7. The burner 10 provides good insulation between the combustion products and the top of the engine E.
8. The burner 10 can provide combustion temperatures of around 1300°C. The quiet operating characteristics of a Stirling Cycle engine are not adversely affected by the burner 10 of the present invention when mounted therewith. By virtue of the construction of the baffling (11, 19, 30, 29, 27, 21) forming the flow paths and the exhaust chamber 28 not all being interconnected together with the inherent strength characteristics of the dish shaped shells, vibrations within the burner 10 are minimized.

Such construction also provides for suitable expansion of the shells (11, 19, 30, 29, 27, 21) without distortion which may otherwise adversely affect the operation and efficiency of the burner 10. By forming the various baffles or shells (11, 19, 30, 29, 27, 21) from what essentially amounts to a plurality of dish shaped elements (made by proven manufacturing techniques) manufacture of the components and assembly thereof to form a burner 10 is not complex and is not labor intensive.

UNITED STATES PATENT AND TRADEMARK OFFICE

CERTIFICATE OF CORRECTION

PATENT NO. : 6,220,030 B1
DATED : April 24, 2001
INVENTOR(S) : Clucas et al.

It is certified that error appears in the above-identified patent and that said Letters Patent is hereby corrected as shown below:

Aspects of the present invention have been described by way of example only and it should be appreciated that modifications and additions may be made thereto without departing from the scope thereof. --

Signed and Sealed this

Twenty-third Day of April, 2002

*Attest:*

*Attesting Officer*

JAMES E. ROGAN
*Director of the United States Patent and Trademark Office*